United States Patent [19]

Nonis

[11] Patent Number: 5,063,718

[45] Date of Patent: Nov. 12, 1991

[54] CURTAIN WALL FOR A BUILDING

[76] Inventor: Al Nonis, 1764 Rathburn Road, Unit 22, Mississauga, Ontario, Canada, L4W 2N8

[21] Appl. No.: 630,555

[22] Filed: Dec. 20, 1990

[30] Foreign Application Priority Data

May 28, 1990 [CA] Canada ..... 2017669

[51] Int. Cl.[5] ..... E04B 2/88

[52] U.S. Cl. ..... 52/235; 52/136; 52/282; 52/463

[58] Field of Search ..... 52/235, 281, 282, 461, 52/463, 136, 137

[56] References Cited

U.S. PATENT DOCUMENTS

| | | | |
|---|---|---|---|
| 2,971,616 | 2/1961 | Bayley, Jr. | 52/235 X |
| 3,124,222 | 3/1964 | Mote | 52/463 |
| 3,266,207 | 8/1966 | Birum, Jr. | 52/459 |
| 3,266,210 | 8/1966 | Grossman | 52/690 |
| 3,316,681 | 5/1967 | Eber | 52/235 |
| 3,427,775 | 2/1969 | Bachrich | 52/463 |
| 3,550,337 | 12/1970 | Lorenz | 52/136 |
| 3,719,014 | 5/1973 | Sukolics | 52/235 |
| 3,797,191 | 3/1974 | Sukolics | 52/664 |
| 3,974,608 | 8/1976 | Grearson | 52/235 |
| 4,055,923 | 11/1977 | Biebuyck | 52/235 |
| 4,074,486 | 2/1978 | Grearson | 52/463 X |
| 4,418,506 | 12/1983 | Weber et al. | 52/209 |
| 4,543,755 | 10/1985 | Crandell | 52/235 |
| 4,574,546 | 3/1986 | Gartner | 52/235 |
| 4,644,711 | 2/1987 | Eikhof | 52/136 X |
| 4,685,263 | 8/1987 | Ting | 52/235 |
| 4,712,345 | 12/1987 | Kaminaga | 52/235 |
| 4,738,065 | 4/1988 | Crandell | 52/235 |
| 4,782,635 | 11/1988 | Hegle | 52/235 X |
| 4,798,035 | 1/1989 | Mitchell et al. | 52/281 |
| 4,831,805 | 5/1989 | Noborisaka | 52/509 |
| 4,899,508 | 2/1990 | Biebuyck | 52/235 |
| 4,903,454 | 2/1990 | Rose | 52/766 |
| 4,905,435 | 3/1990 | Horst | 52/235 |
| 4,905,444 | 3/1990 | Semaan et al. | 52/710 |

*Primary Examiner*—Richard E. Chilcot, Jr.
*Assistant Examiner*—Kien Nguyen
*Attorney, Agent, or Firm*—Ridout & Maybee

[57] ABSTRACT

A curtain wall for a building structure is provided in which structural members and diaphragms are used to reinforce a relatively light frame such that the number of connections to the building required is reduced to one or two. The curtain wall module comprises a frame having a top and bottom chord and a plurality of transverse studs spaced at intervals along the length of the chords defining a plurality of panels. Exterior cladding including a layer of sheet metal is mounted to the exterior face of the frame strengthening the frame as a stressed diaphragm. In the preferred embodiment the top chord of the frame includes a relatively strong reinforcing beam (such as a square hollow structural section) parallel to and connected to the top chord along the full length of the top chord. The weight of the wall may be supported upon the building by vertically adjustable connectors at two points on the beam. Vertical pins connected to the upper surface of the beam project through the bottom chord web of a like upper adjacent wall module. Diagonally slotted washers engage the pins to allow adjacent modules to be aligned while allowing adjacent modules to deflect vertically relative to each other in an unrestricted fashion.

28 Claims, 9 Drawing Sheets

CURTAIN WALL FOR A BUILDING

TECHNICAL FIELD

The invention is directed to a curtain wall for a building structure, which is reinforced such that a reduced number of connections to the supporting building structure are required.

BACKGROUND ART

In the construction of enclosed buildings, it is generally most efficient to construct the columns, floors, roof, and internal supporting walls initially and thereafter to enclose the structure by constructing the exterior walls. Curtain walls have been developed which are prefabricated and erected in modules of a manageable size and weight. The wall modules are of a height generally equal to the building's storey height. Each module is supported by connectors upon the outer area of the building floor. Modules are stacked upon each other in parallel rows and adjacent modules are often mechanically connected together. The gap between adjacent modules is sealed with caulking to provide a weather proof exterior wall.

Although, modules may be constructed as load bearing exterior walls, commonly in higher buildings, each building floor supports a row of modules of a height equal to the building's storey height. In general, most buildings are composed of planar vertical exterior walls and the walls are constructed in rectangular modules. Although, the description herein relates to exterior walls of such rectangular modules, it will be understood that wall modules of this type may be constructed in any form (with a curved or an angular surface, for example) and that such modules also may be utilized in constructing interior walls (in atrium structures, for example).

Conventional curtain wall modules comprise a frame having a horizontal top chord, a horizontal bottom chord and a plurality of vertical transverse studs spaced at intervals along the length of the chords thereby defining a plurality of panels. The top and bottom ends of each stud are nested within and connected to the top and bottom chords respectively by spot-welding or with mechanical connectors. The chords and studs are generally light channel sections made of roll-formed galvanized sheet steel. Additional frame members may be used to frame openings for windows and doors.

Exterior cladding of various types is mounted to the exterior face and exposed edges of the frame. The cladding may comprise rigid insulation, gypsum board, plywood, foam insulation, and fabric reinforcing to form a solid backing for a variety of weatherproof finishes applied to the backing such as split bricks, stucco or epoxy resins.

Windows and doors may be installed within the openings in the frame during prefabrication in an indoor factory or shop. The completely fabricated wall module is relatively light, and therefore, even though the module has a low section modulus longitudinally, the chords are generally of sufficient strength to avoid lateral buckling or excessive deflection during handling and installation. The design live load from wind induces stresses in the module many times greater than those stresses induced by the module's dead load. Since the governing load is wind load the sheet metal channel studs are designed to have adequate capacity to resist transverse bending loads in their installed state being supported at both ends by the chords. In conventional modules to prevent overstressing of the chords under the load imposed by the studs, the chords are connected to the floors of the building at multiple points spaced along the length of the module to ensure that the wind loads are transmitted from the studs to the chords then to the building. When a module is overstressed or deflects excessively the cladding may be torn from the connectors and the frame, and the relatively brittle cladding may crack and delaminate.

Stresses also may be introduced in the modules by differential settlement or deflection of the supporting floors of the building. When multiple connections are used the light weight modules are forced to conform to the shape of the floor and buckling or failure of the module's cladding may occur. The building floors may settle or deflect under live loads, due to concrete creeping, or due to foundation settlement.

To minimize the risk of damage in shipping the completed wall modules are shipped to the building site in an inclined position approximately 70°–80° to horizontal upon A-frame truck trailers. The wall modules are lifted by a crane at the building site and installed on supporting brackets attached to the outer edges of the building's floors.

Due to the relatively low resistance of the chords of conventional wall modules to bending stress, such wall modules must be connected to the building floors at several points along their lengths. In this way, lateral buckling of the chords is prevented and vertical deflection of the module between connections is reduced to acceptable levels. Large numbers of support connections must be fabricated and installed for each module consuming materials and time. Since the available time for installation at a building site is usually limited by construction schedules, and the cost of labour is relatively expensive; a connection design which requires multiple support points reduces the cost efficiency of such prefabricated curtain walls, as well as rendering the module prone to failure when the supporting structure settles or deflects differentially.

In order to strengthen conventional wall modules, structural members of strength greater than the chords and studs have been introduced to reinforce the modules. Commonly, a rolled angle iron or channel section, or a hollow structural section is attached to the periphery of the module connected parallel to both chords at least and may also be connected parallel to the outer studs to fully encircle the frame. Such a conventional design increases the resistance to lateral buckling, vertical deflection and bending. In addition, such a module requires fewer connections since the structural members span between connections supporting the relatively light frame. A frame which includes structural members along the full length of the top and bottom chords, and which may include transverse outer structural members along the outer studs is significantly more complicated to fabricate and is heavier than a module lacking such reinforcing. The conventional reinforced module is therefore significantly more expensive to fabricate and the building structure must be of sufficient structural strength to support the additional weight of the modules.

Conventional connectors used in association with reinforced modules include a short angle iron with attached reinforcing bar or welded studs embedded in the outer edge of the concrete floors of the building. A short member of angle or channel is placed extending transversely to the module. The module is suspended from a crane during installation. The extending member is welded to the embedded angle and is welded to the inner face of the structural member of the suspended module. After welding is completed, the module is released from the crane. The module is suspended from the cantilevering extending member which is itself supported by the embedded angle in the floor of the building. The field welding of the connector to the module allows for a large degree of adjustment and alignment of individual panels during installation and the reinforced module need only be connected to the building in this way at two points along the length of the structural member to support the weight of the module. The disadvantages of such field welded connections are that a crane is fully occupied during alignment and welding and subsequent correction to the positioning of the module is very difficult. Welding the extending member to the outer face of the building's structural member is preferred since the outer face is generally the only face that is accessible and downhand welding may be performed avoiding difficult overhead or hidden welding positions. However, connecting to the outer face of the structural member induces torsional stresses in the structural member and in the module. These torsional and transverse bending stresses are accommodated by increasing the torsional strength of the structural member and increasing the strength of the studs and connections to the building.

It is, therefore, desirable to provide a wall module that is resistant to bending, buckling and vertical deflection during handling and in its installed condition, that is relatively light weight, and is easily fabricated.

It is also desirable to provide a wall module which requires as few connectors as possible requiring intrusion upon the building structure design in order to reduce design, material and labour costs, especially during site construction.

It is also desirable to provide a wall module having connections which do not induce additional stresses into the modules and connections in order to minimize the necessary strength and weight of the modules.

It is also desirable to provide a wall module having connectors which enable adjacent modules to be aligned and positioned relative to each other in a rapid manner in order to reduce site construction costs and installation time.

DISCLOSURE OF THE INVENTION

A curtain wall in accordance with the invention addresses the above disadvantages associated with conventional wall modules described above, in providing a novel reinforced wall module and novel connection means.

In accordance with the invention is provided a curtain wall module for a building structure, comprising a frame having a top chord, a bottom chord and a plurality of transverse studs spaced at intervals along the length of the chords defining a plurality of panels. The top end of each stud is connected to the top chord and the bottom end of each stud is connected to the bottom chord. One of the chords consists of a single inwardly open channel section. The other chord includes a parallel reinforcing beam of strength greater than the channel section to reinforce the chord along all or part of its length. Sheet form cladding is mounted to the frame, which in certain embodiments is sheet metal to provide the frame with diaphragm strength. Adjustable restraint means are connected to the frame and the building structure for transferring the weight of the module, and the loads imposed upon the module, to the building structure.

The reinforcing beams described of the present invention are required only adjacent one chord of the frame. In the preferred embodiments, the reinforcing beam is connected to the top chord in order that the studs remain in tension suspended from the top chord. Since the studs are preferably open channels made of thin roll formed sheet metal, they are relatively weak in compression especially at their unrestrained inner flanges, and therefore, are most efficient in load bearing while in tension. In a beam reinforced frame, the exterior cladding may serve no structural purpose. However, in those embodiments not relying on beam reinforcement, sheet metal or other rigid strong material is connected to the frame in such a manner as to develop the diaphragm strength of the cladding, thereby reinforcing the frame. The restraint means are vertically adjustable after installation and engage the module near the module's centre of gravity in order to reduce torsional stresses and to allow the module to be aligned after installation while supported on the restraint means. Through the combination of diaphragm strength of the cladding, reduced weight resulting from the use of a single reinforcing beam or the use of stub reinforcing beams in combination with rigid sheet cladding, and novel connection design minimizing torsional stress, a wall module in accordance with the invention provides weight and cost reductions over conventional modules without sacrificing strength. The restraint means enable the alignment and positioning of adjacent modules after installation in a manner to be described in detail below.

BRIEF DESCRIPTION OF THE DRAWINGS

In order that the invention may be readily understood, embodiments of the invention will be described by way of example with reference to the accompanying drawings.

BEST MODE OF CARRYING OUT THE INVENTION

Figure 1:
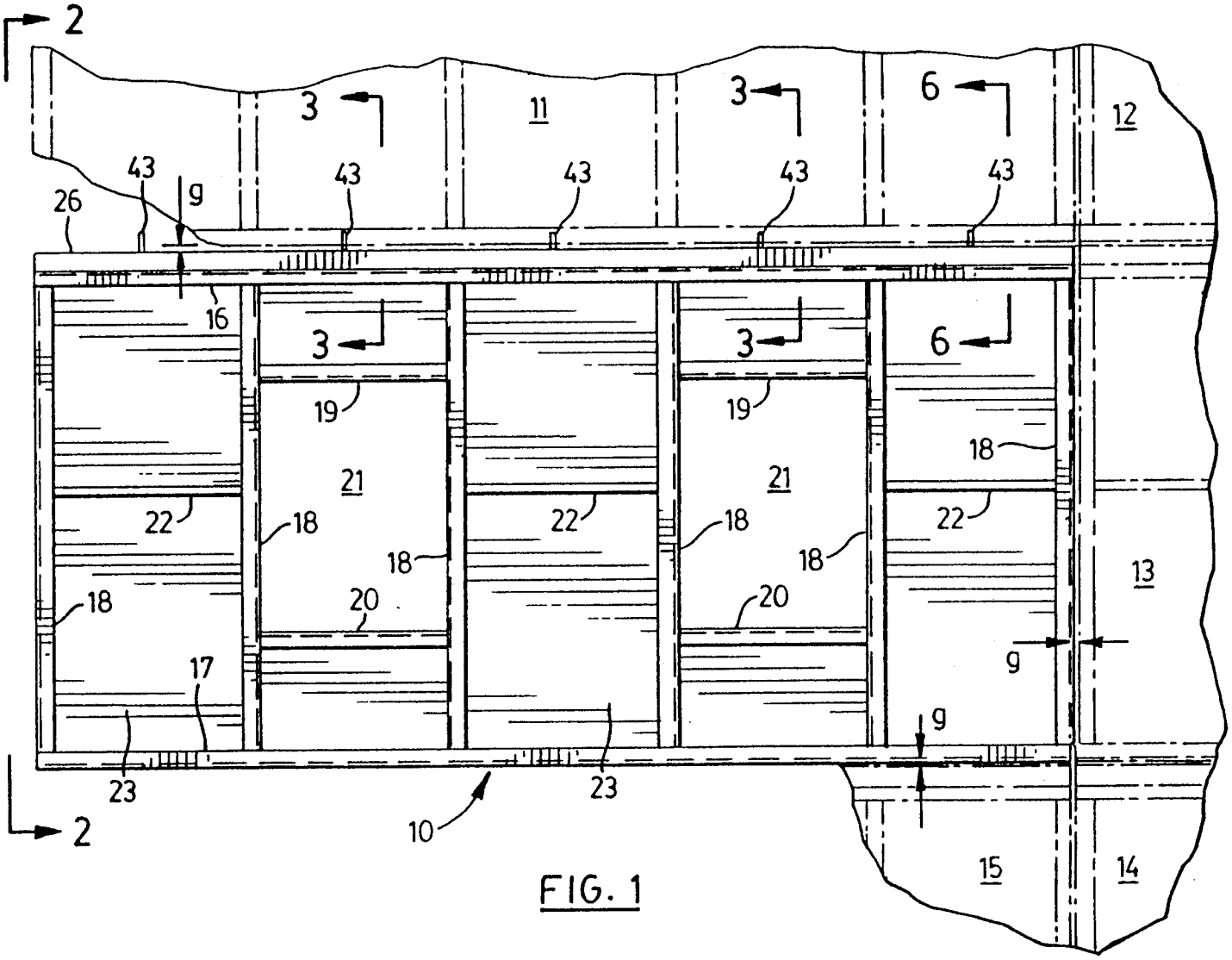
FIG. 1 is an elevation view of the inner surface of a first rectangular curtain wall module having a full length reinforcing beam, showing partially broken away adjacent wall modules in dashed-dotted outline.
Figure 2:
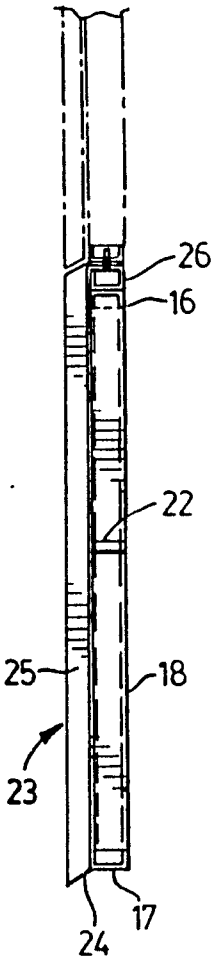
FIG. 2 is a side elevation view along line 2—2 of FIG. 1.

Referring to FIG. 1 the general arrangement of a first embodiment of a curtain wall according to the present invention is illustrated. A rectangular wall module 10 is part of a planar curtain wall attached to the exterior of a building structure. Adjacent wall modules 11 to 15 form an array of rows and columns of like modules. Although the drawings and description relate to such a common application, it will be understood that wall modules may be constructed in a variety of shapes to conform to the building exterior profile and may be used for interior walls also.

A wall module 10 of the curtain wall is prefabricated in an off site shop generally by first constructing a frame having a top chord 16, a bottom chord 17 and a number of transverse studs 18, defining panels within the wall module 10. Additional members may include lintels 19 and sills 20 for framing openings 21 for windows, or doors. Diagonal members (not shown) may be included to span diagonally across a panel increasing the shear strength of the module 10. The chords 16 and 17, studs 18, and other frame members 19 and 20 are in general roll-formed sheet metal channel sections. In order to brace the studs 18 to prevent buckling under installed design loads, bridging members 22 are provided. The top end of each stud 18 is connected to the top chord 16 and the bottom end of each stud 18 is connected to the bottom chord 17. The frame members 16 to 22 may be welded together or may be joined by mechanical fasteners in a conventional manner.

When the frame is completely fabricated, exterior cladding 23 is mounted to the frame. In the case of the module 10 illustrated in FIG. 1, the frame has only one exterior face, but in the case of an L-shaped module, for example, two exterior faces are provided with cladding 23. The cladding 23 may comprise any suitable material as described above in association with conventional wall modules. In a preferred embodiment of the invention (see FIG. 8), the cladding 23 is a sheet material connected to the frame members 16 to 22 in such a manner that the diaphragm strength of the cladding 23 (primarily in tension) is developed to strengthen the frame by spanning the panels of the frame. Sheet metal cladding material is preferred due to its relatively high strength and ease of connection; however, other sheet materials, such as fibre reinforced cement board, may be used in certain circumstances.

Figure 9:
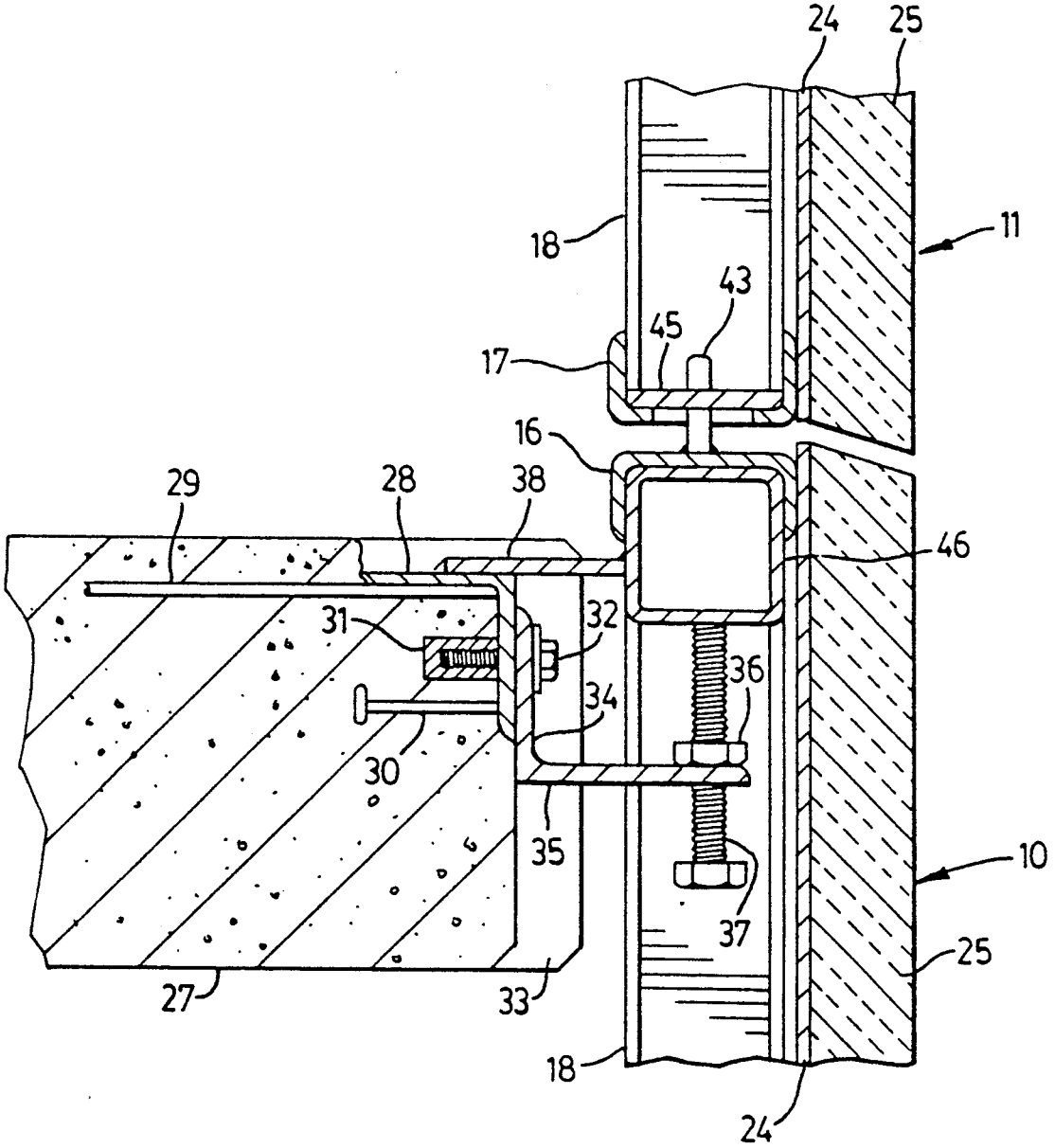
FIG. 9 is a detail sectional view along lines 9—9 of FIG. 8.

To provide a preferred structural diaphragm therefore, a layer of sheet metal 24 is placed upon the exterior face of the module 10, as shown in FIG. 9. The sheet metal layer 24 is preferably connected to the frame members 16 to 22 with self-drilling self-tapping sheet metal screws but spot-welding or rivets may also be used. The sheet metal layer 24 may also serve as a supporting backing for other elements of the cladding, such as rigid insulation 25, for example, which may be mounted on screws which pierce the sheet metal layer 24. The sheet metal layer 24 may additionally serve as a vapour and air barrier for the wall if all joints and punctures from connectors are sealed. For example, aluminium foil adhesive tape may be applied to all joints in the sheet metal layer 24, and may cover the rows of sheet metal screws. A sealing adhesive may be applied between the sheet metal layer 24 and insulation 25 in the area through which insulation mounting screws project to seal the resultant puncture. Thereafter, a finish coating is applied to the insulation 25 to render weatherproof the exposed surface of the module 10 in a conventional manner.

The use of a sheet metal layer 24 enables sections of insulation of any convenient stock size to be used since the layer 24 provides adequate support at any point in its surface. In contrast, conventional modules utilizing gypsum board or cement board, for example, do not sufficiently support insulation fasteners. Therefore, insulation must be cut and fitted to enable connection to the studs of the frame resulting in increased material wastage and labour costs.

To install insulation upon a module 10 according to the invention the insulation mounting screws and a washer are countersunk in the outer surface of the insulation. Typically the washer and countersunk recess are about 2 inches (50 mm) in diameter. A cylindrical insulation plug is then fitted into the countersunk recess on top of the mounting screws to prevent heat loss in the area of the screws. As a result of utilizing a sheet metal layer 24 in the cladding 23, therefore, the spacing of insulation mounting screws may be made uniform and optimized to reduce stress in the cladding 23 due to the temperature differential. Also, the efficient use of any insulation stock is enabled without cutting and fitting.

Figure 8:
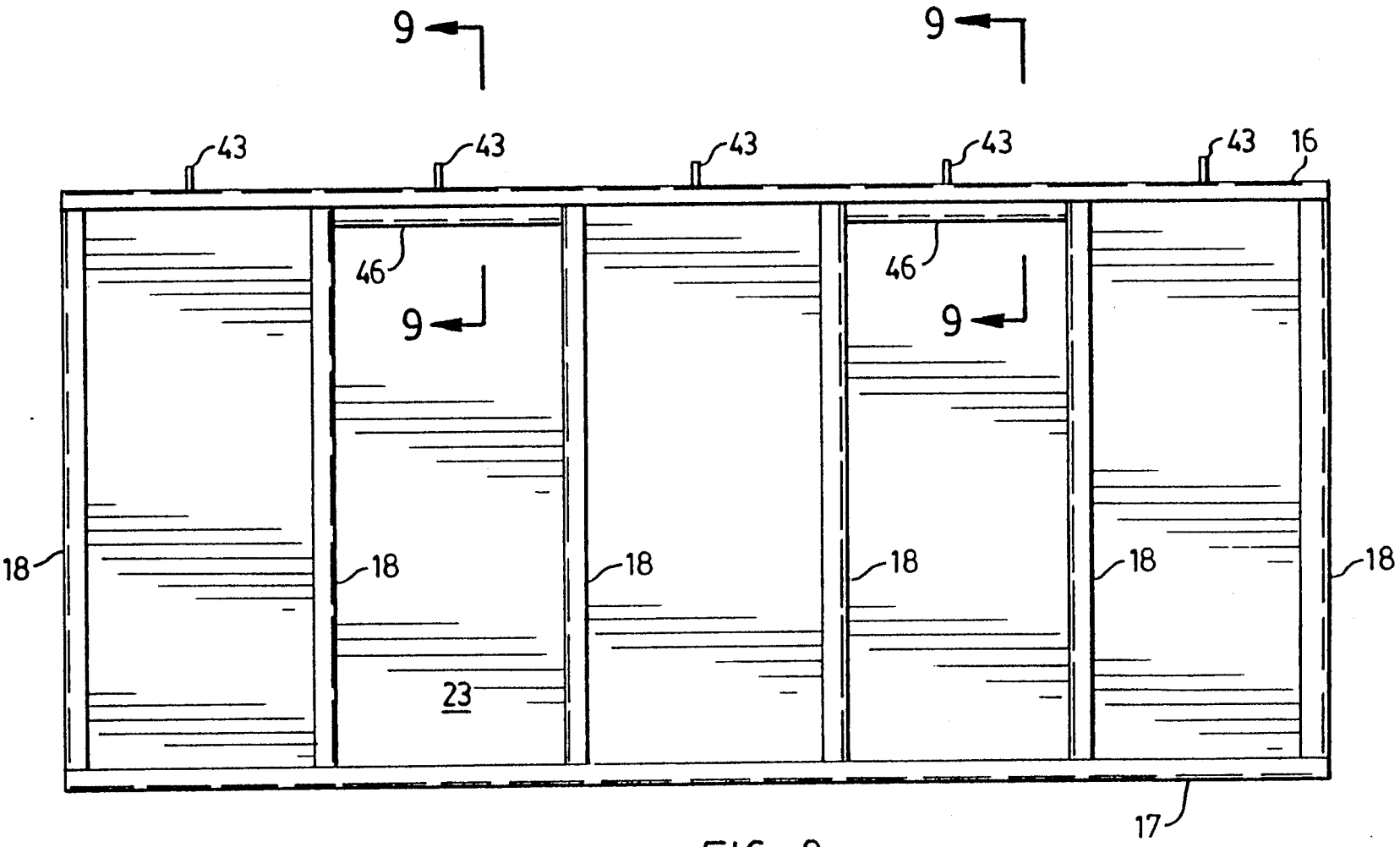
FIG. 8 is an elevation view of the inner surface of a second rectangular curtain wall module having a stub beam between the studs of the second and fourth panels.
Figure 10:
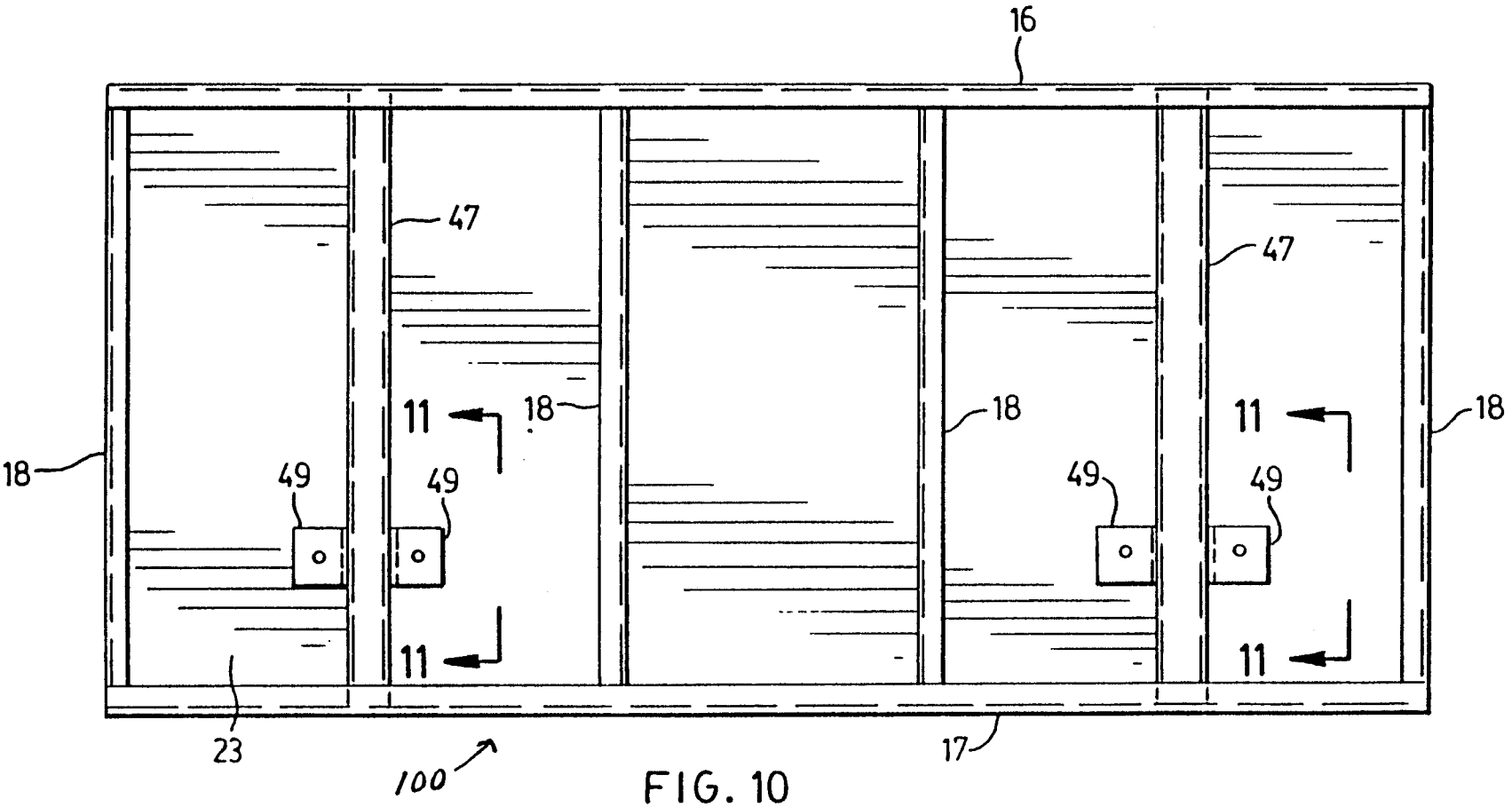
FIG. 10 is an elevation view of the inner surface of a third rectangular curtain wall having two studs comprising a structural member with angle connections.

Depending upon the size, shape, and weight of the wall module 10, the design live loads, and the design of the building structure, the chords 16 and 17 of the frame may include various structural members to reinforce the frame. FIGS. 1, 8, and 10 illustrate first, second and third embodiments showing three examples of designs in which the modules 10 may be reinforced in accordance with the invention.

In the drawings a first embodiment is illustrated in FIGS. 1–7 wherein the bottom chord 17 consists of a single upwardly open channel section. The top chord 16 includes a structural member 26 parallel to and connected to the upper face of the top chord 16 along its length. A hollow square structural section as shown in the drawings is preferred due to high torsional strength and ease of fabrication but any suitable structural section may be used to provide adequate reinforcing of the top chord 16.

In the first embodiment the other members of the frame are suspended from the beam 26 such that the studs 18 are in tension under the weight of the module 10. The beam 26 is connected by welding or with mechanical fasteners to the top chord 16 along its full length, thereby increasing the strength of the module 10 by reinforcing the top chord 16. During handling and in its installed state connected to the building, the rectangular module 10 generally need only be supported vertically at two points on the beam 26 for example between the studs 18 of the second and fourth panels. Failure of the top chord 16 under the lateral wind loads imposed by the studs 18, through lateral buckling or excessive vertical deflection is prevented by the inclusion of the parallel reinforcing beam 26. The bottom chord 17 being connected to the top chord 16 of the lower module 15, need not be reinforced. The bottom chord 17 is of sufficient cross-sectional area to resist longitudinal bending stresses. The module 10 may be lifted by a crane during fabrication and installation at two points along the length of the top chord 16. Two removable lifting eyelets each with a threaded stem may be used having the stems projecting vertically through holes in the beam 26 and top chord 16. Therefore, the full length beam 26 is capable of reinforcing the module 10 to a sufficient extent that without reinforcing of the bottom chord 17 the module 10 may be supported vertically at two points only, thereby reducing the number of connectors to the building, and allowing the building to settle or deflect without inducing stress in the modules 10. The modules 10 merely float on two connectors as the building moves.

A second embodiment of the invention shown in FIGS. 8 and 9 relies upon the diaphragm reinforcing of the exterior cladding 23 to primarily strengthen the frame. In the second embodiment the bottom chord 17 consists of a single upwardly open channel section. The top chord 16 includes at least one reinforcing stub beam 46 parallel to and connected to the top chord 16 between the studs 18 of at least one panel. The structural stub beams 46 are positioned in FIG. 8 in the second and fourth panels nested below the top chord 16 adjacent the connections to the building. The stub beams 46 distribute the concentrated load from the connection over the frame and attached cladding diaphragm surface of the wall module 10. The connections supported upon the building engage the stub beams 46 of the top chord 16 as shown in FIG. 9. Local crushing, tearing or bearing failure of the top chord 16 is thereby avoided since the stub beam 46 distributes the concentrated load to the adjacent studs 18, and the diaphragm action of the cladding 23 further distributes the load throughout the wall module 10.

Figure 3:
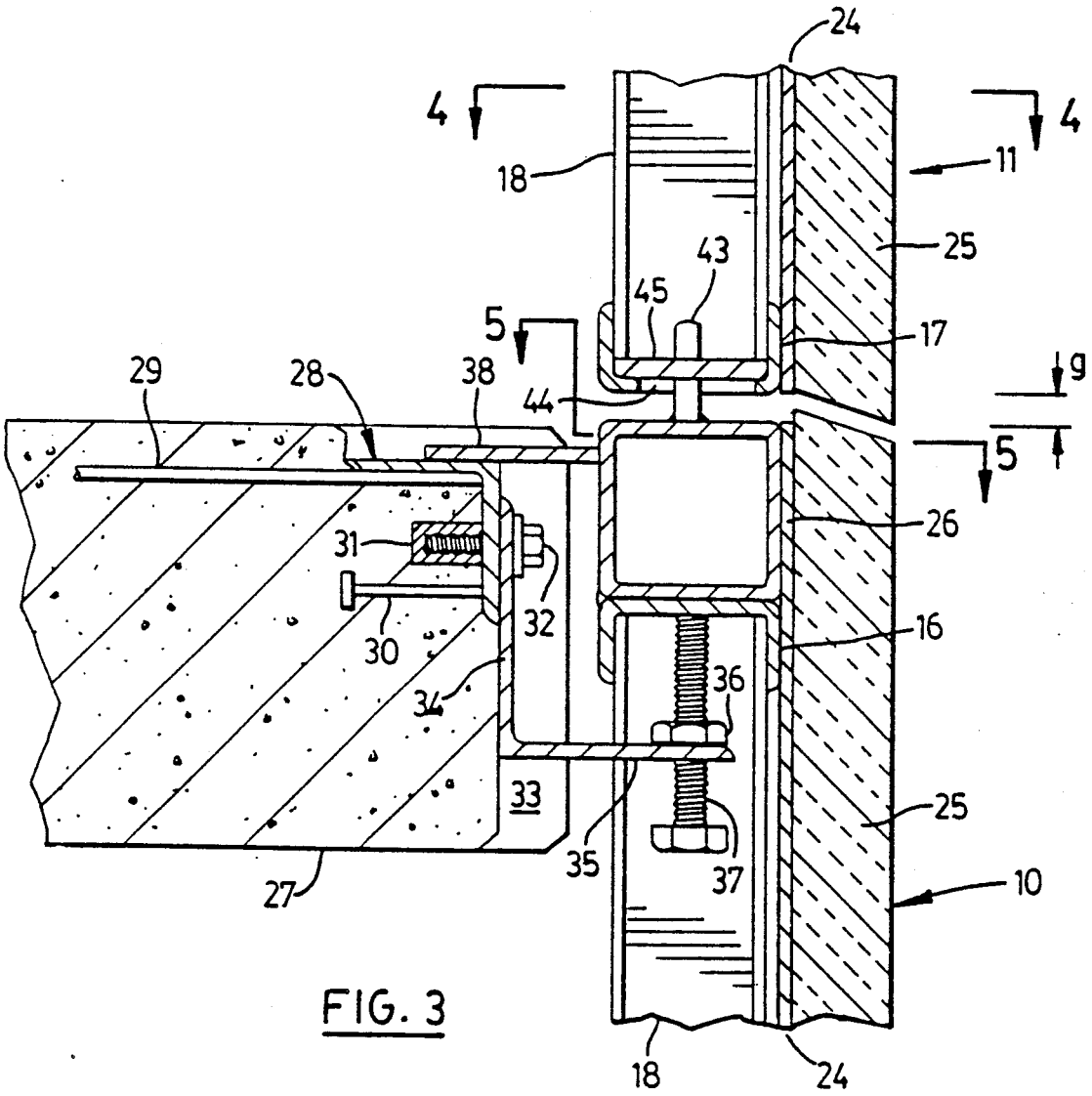
FIG. 3 is a detail sectional view along lines 3—3 of FIG. 1 showing the top position wall module installed upon showing two vertical restraint means connected to a concrete floor of a building structure, and showing the connection to the bottom portion of an upwardly adjacent wall module.

A wall module 10 according to the invention includes various restraint means connected to the frame and connected to the building structure 27 for transferring the weight of the wall module 10, and the loads imposed on the wall module 10, to the building structure 27. In order to avoid inducing torsional stresses in the frame, the restraint means are connected to the frame between the interior and exterior faces of the frame, and preferably, as close as possible to the centre of gravity of the wall module 10. As shown in FIGS. 3 and 9, the restraint means may conveniently include vertical adjustment means for raising and lowering the wall module 10 when the module 10 is supported by the restraint means. A short section of the steel angle 28 or bent plate is embedded within the concrete floor 27 of a building. To secure the embedded angle 28 a short length of reinforcing bar 29, or headed studs 30, or both are welded to the inner face of the embedded angle 28. An internally threaded ferrule 31 is mounted to the embedded angle 28 to receive a mounting bolt 32 and washer. The embedded angle 28 may be housed within a. recessed pocket 33 in the building floor 27 to avoid protrusions above the floor level. One end of a mounting angle bracket 34 is connected to the embedded angle 28 by the mounting bolt 32, and at its opposite end a horizontal leg 35 extends outwardly between the studs 18 and chords 16 and 17 of a panel inward of the exterior face of the wall module 10. A nut 36 is welded to the horizontal leg 35 adjacent a hole through which a leveling bolt 37 extends. The leveling bolt 37 is in threaded engagement with the nut 36 and has a longitudinal axis substantially parallel to that of the studs 18. The forward upper end of the leveling bolt 37 supports the weight of the module 10 upon the top chord 16.

To secure the wall module 10 horizontally, a horizontal plate 38 is provided for transferring horizontal loads from the module 10 to the building structure 27 and for restraining horizontal movement of the module 10. The plate 38 is welded to the embedded angle 28 and to the top chord 16 (including the beam 26 or stub beam 46) after the module 10 is positioned in its desired location.

Figure 6:
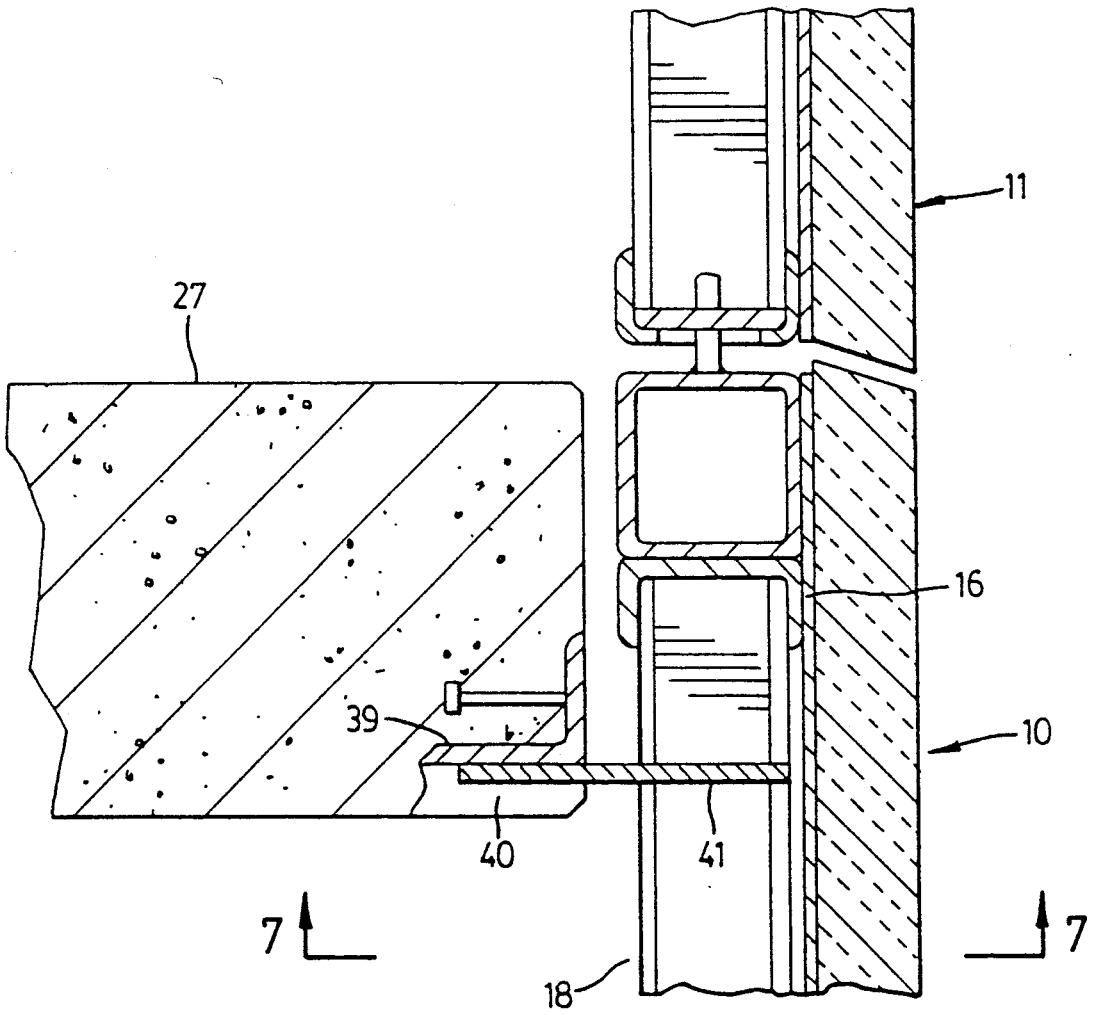
FIG. 6 is an elevation view of a typical horizontal bracing connection between the concrete floor of a building and a stud of the frame.
Figure 7:
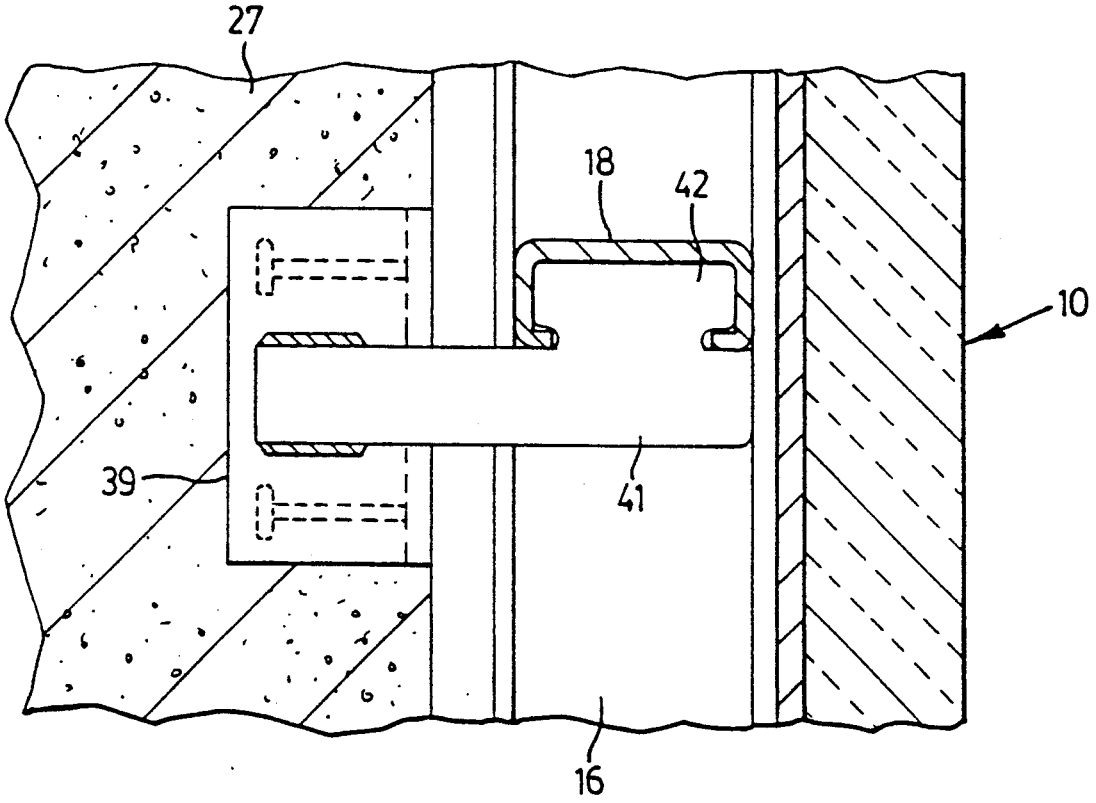
FIG. 7 is a detail sectional plan view along line 7—7 of FIG. 6.

Referring to FIGS. 6 and 7, in all embodiments horizontal braces may be provided at various points along the chords 16 and 17 for transferring lateral loads from the wall module 10 to the building structure 27, for restraining the wall module 10 laterally, and for allowing relative vertical movement due to settlement and deflection between the module 10 and the building structure 27. A bracing angle 39 is embedded within the outer edge of the building floor 27 and may be recessed within a pocket 40 in the floor 27. A bracing strut 41 slidingly engages the interior surfaces of an adjacent channel section stud 18 at its outer end 42, and the inner end of the bracing strut 41 is welded to the bracing angle 39 after the module 10 is positioned in its desired location. The outer end 42 may be accurately cut with laser or plasma cutting equipment to fit like a key within the inner profile or keyway of the stud 18. The stud 18 may slide vertically relative to the strut 41 as the module 10 or building deflects under load, while the strut 41 restrains the stud 18 laterally and transfers lateral loads to the floor 27.

The following sequence of activities is carried out during installation of wall modules 10 on a building to form an exterior curtain wall. Prefabricated wall modules 10 are shipped from the fabricating shop to the construction site on A-frame truck trailers. The lifting eyelets connected to the top chord 16 for handling during fabrication are left on the module 10 to facilitate lifting at the site and are removed for reuse after the module 10 is secured and supported upon the leveling bolts 37.

The site crane lifts a module 10 from the A-frame trailer to the building floor area of its intended final location. Workers guide the module 10, as it is suspended from the crane, onto the leveling bolts 37. The crane is then released and immediately proceeds to lift another module 10 from the A-frame trailer. Workers temporarily secure the module 10 as it is supported upon the leveling bolts 37 in its approximate final position. The horizontal plates 38 (see FIGS. 3 and 9) or bracing struts 41 may be tack-welded to temporarily secure the module 10 at its upper end. The bottom end of the module 10 may be secured by loosely fitting the bottom chord 17 over anchor bolts (not shown) in lower foundation walls or upon link pins 43 projecting upwardly from the top chord 16 of a lower adjacent module 15. The module 10 is not necessarily secured in its final installed position but need only be placed upon the leveling bolts 37 in an approximate position, since the restraint means are such that the module 10 may be easily aligned and positioned after all surrounding adjacent modules (11–15 and others) are positioned in their respective approximate final locations. Referring to FIGS. 1 and 3, the module 10 is separated from adjacent modules by a gap 'g' which is typically in the range of $\frac{3}{4}$ to $\frac{3}{8}$ inches (20–10 mm), and which allows a module 10 to independently shift an adequate amount during final positioning. The gap 'g' is sealed with conventional sealants after all modules are in their final positions.

In this way, therefore, the use of the site crane is reduced, and the efficiency of installation workers is increased resulting in cost savings. An A-frame trailer generally carries twenty or more modules. Due to the ease of connecting as described above, the trailer may be quickly unloaded and returned to service in an installation operation which proceeds rapidly and does not require double-handling or site storage. When a load of modules 10 arrives at the site, the installation workers rapidly secure the modules 10 temporarily in their approximate final positions, thus enclosing the building and freeing the crane and trailer for other uses. The installation workers may then proceed to align the temporarily secured modules 10 in their final positions, or may proceed to unload another trailer of modules 10 while a second crew aligns the temporarily secured modules 10. Therefore, by separating the aligning and installing operations, more efficient use of equipment and labour results, and the building ma be rapidly enclosed.

Through conventional surveying methods the desired final position of a temporarily secured module 10 is determined. If the module 10 must be moved, the temporary tack-welds connecting the horizontal plates 38 or struts 41 are removed, thereby releasing the module 10 such that it rests only upon the two leveling bolts 37. It is also possible to design cantilevering modules 10 which have only one leveling connector, or modules 10 with only one central leveling connector, wherein other connectors (as shown in FIGS. 6 and 7) of the modules 10 allow vertical movement relative to the building. The most common case, however, is where a rectangular planar module 10 is supported at two points along its top chord 16.

The top chord 16 of the module 10 to be positioned may be levelled, raised, or lowered by turning the leveling bolts 37. The top chord 16 may be moved transversely inwardly or outwardly relative to the building floor 27 by sliding the top chord 16 along the upper end of the leveling bolt 37. When the top chord 16 is correctly positioned in its desired final location, the horizontal plate 38 is fully welded to the top chord 16, or the beam 26, and to the embedded angle 28. The leveling bolt 37 may be secured against unintended rotation by spot welding to the horizontal leg 35 or to the top chord 16, or beam 26.

Figure 4:
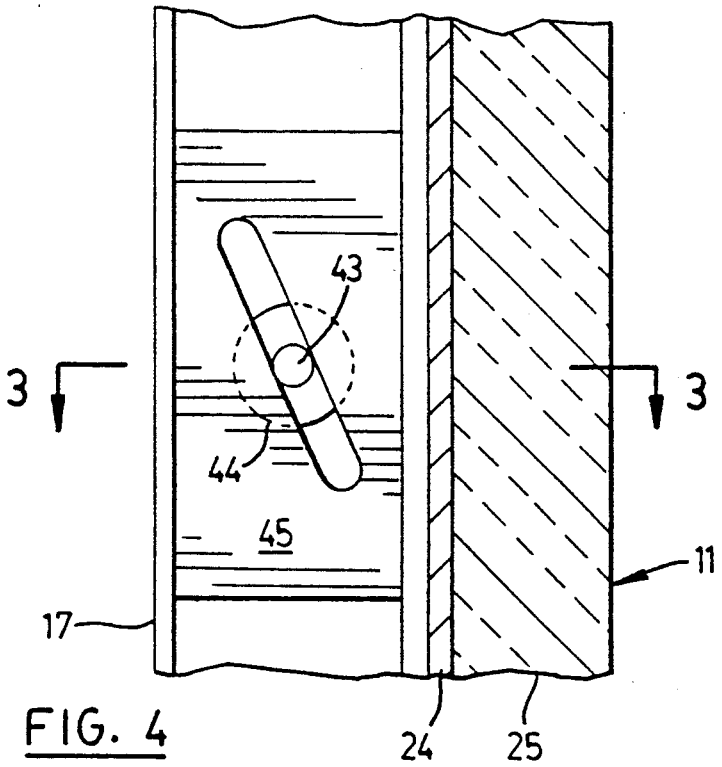
FIG. 4 is a plan detail sectional view along line 4—4 of FIG. 3.
Figure 5:
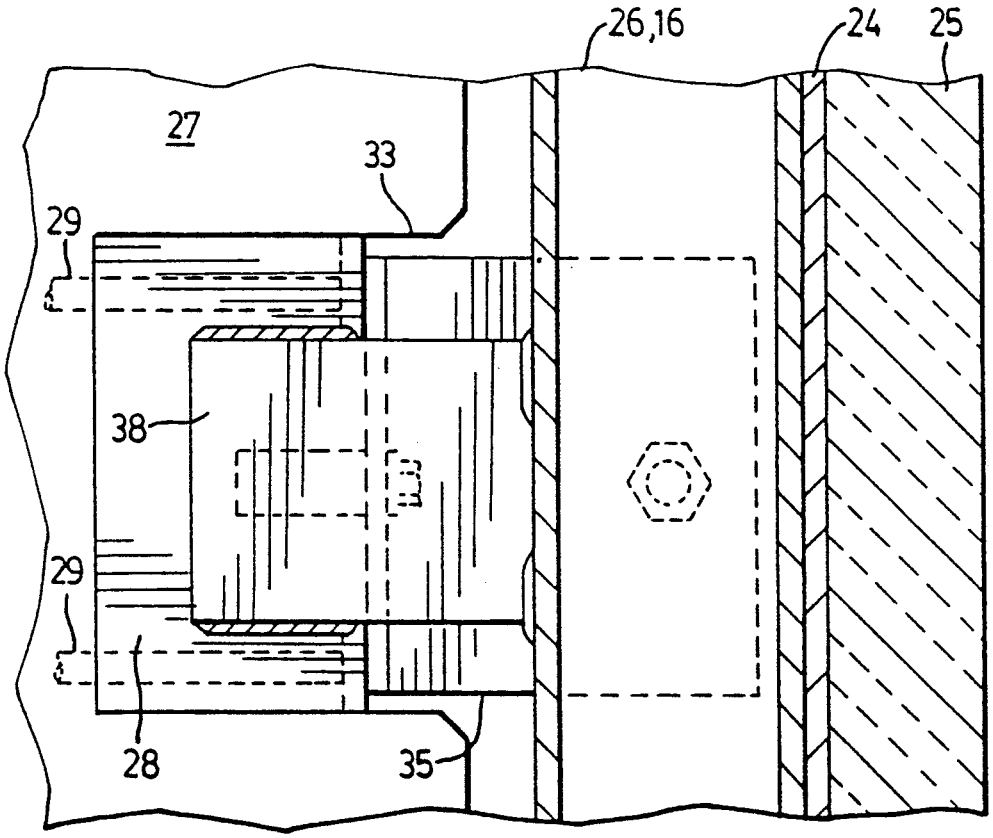
FIG. 5 is a plan detail sectional view along line 5—5 of FIG. 3.

The bottom chord 17 is connected and aligned to the top chord 16 of an adjacent module 10 or upon foundation anchor bolts (not shown) by means enabling the modules 10 to be vertically stacked in a parallel configuration. Referring to FIG. 3 and 4, the bottom chord 17 consists of a single upwardly open sheet metal channel section having a plurality of holes 44 in the web of the channel. A plurality of longitudinally spaced mating vertically aligned pins 43 project from the upper face of the top chord 16 of the lower adjacent module 10. The pins 43 engage and project through the holes 44 which are oversized to allow the bottom chord 17 of the upper module 11 to move transversely relative to the top chord 16 of the lower module 10. A rectangular diagonally slotted washer 45 is placed over the pin 43. The outer edges of the slotted washer 45 are in sliding engagement with the interior longitudinal sidewalls of the bottom chord 17. Referring to FIG. 4, a hammer striking the top transverse edge of the washer 45 will drive the bottom chord 17 to the right away from the building, and striking the bottom edge will drive the bottom chord 17 to the left toward the building, since the pin 43 is fixed in position on the building by the horizontal plates 38. When the upper and lower modules 11 and 10 are properly aligned and the bottom chord 17 is in its final position the washer 45 may be welded or secured by screws in place. The upper and lower modules 11 and 10 may move vertically relative to each other without inducing stresses in each other since the caulking in gap 'g' between them is flexible.

A particularly advantageous feature of a wall constructed in accordance with the invention is the ability to remove a single module 10 from the wall if desired to enable building additions or renovations, to install large machinery within the building, or to repair the module or building structure. Since the modules 10 are independently supported and are easily moved relative to each other, a module may be easily removed as follows. The horizontal plates 38 and struts 41 are removed by gouging or grinding off the welds. The slotted washers 45 are removed and the leveling bolts 37 turned to lower the module 10 such that the top of the pins 43 clear the bottom chord 17 of the upper module 11. Referring to FIG. 3, the top chord 16 of the lower module 10 is moved outward until the top end of the leveling bolt 37 engages the inner corner of the top chord channel 16. Referring to FIG. 9 a plate (not shown) may be temporarily welded to the inner face of the stub beam 46 to abut the leveling bolt 37 in a like manner. Lifting eyelets are installed and a crane employed to lift the module 10 from the leveling bolts 37 at its top and from the pins 43 of the adjacent lower module 15 at its bottom. Care must be taken during removal and reinstallation to avoid damaging adjacent modules.

A further advantageous feature is the minimal intrusion required by the connections upon the design of the building floor slab 27. Referring to FIGS. 3 and 6, the depth of the recess in the floor slab 27 need only equal the thickness of the respective horizontal plate 38 or strut 41. FIG. 3 shows the vertical face of the slab 27 also recessed, but it will be apparent that the embedded angles 28 and 39 need not be recessed but rather may be positioned at the upper and lower edges of the slab 27, if desired. The relocation of slab reinforcing bars and formation of large recesses when pouring the floor slab concrete may be avoided.

Figure 11:
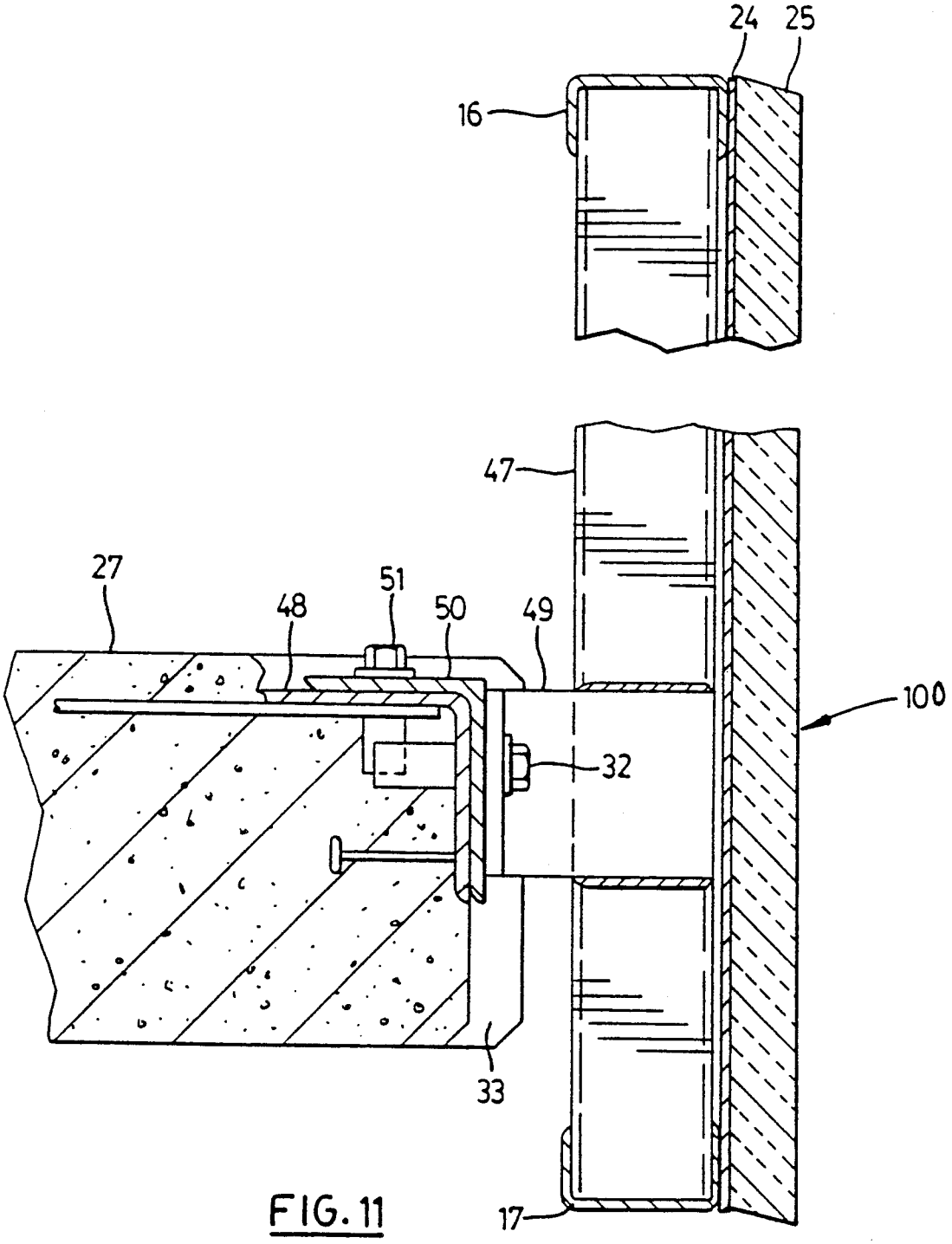
FIG. 11 is a detail sectional view along lines 11—11 of FIG. 10.

Referring to FIGS. 10 and 11, a module 10 in accordance with a further embodiment of the invention is illustrated. The frame and cladding 23 are essentially the same as described above with the significant exception that adjacent modules 100 do not connect to each other. Modules 100, as illustrated in FIG. 10, do not span from building floor to building floor, but rather are approximately half the storey height, separated by a band of window frames on each floor of the building. Above each module 100 is placed a band of window frames of conventional design. The end result, therefore, is an exterior building wall comprising a band of laterally adjacent modules 100 along each building floor having an upper band of windows spanning vertically between the modules 100 of each floor. The modules 100 being of approximately one half the height of modules 10 described above may be reinforced and connected to the building using columns 47 as illustrated. At least one stud comprises a column 47 of strength greater than that of the remaining studs 18. For example, as shown in FIG. 10, the columns 47 may be square hollow structural sections, whereas the studs 18 are roll-formed sheet metal channel sections. The top and bottom chords 16 and 17 may be either roll-formed sheet metal channel sections or hot-rolled steel channels depending upon the design loads imposed. The combination of the diaphragm reinforcing of the sheet metal cladding 24, the columns 47, and optionally reinforced chords 16 and 17, results in a module 100 of increased strength which may be connected to the building at one or two points.

The restraint means includes an embedded bent plate 48 which may be recessed in a pocket 33 of the building floor 27. Back-to-back angles 49 are rigidly connected to the columns and include holes in their inner legs for mounting the module 100 upon two mounting bolts 32. The columns 47 may include a tubular portion of smaller dimension, (not shown) which slides within the interior of the remainder of the tubular column 47 to provide telescoping leveling adjustment of the module 100. The smaller portion is welded to the remainder of the column when the module 100 is placed in its final position. A clip angle 50 has one leg between the embedded plate 45 and the back-to-back angle 49 and a second leg upon the embedded plate 48. A single bolt 51 extends through a slotted hole in the second leg to secure the clip angle 50 in position. The clip angle 50 and back-to-back angle 49 are rigidly welded together in order to provide a secure mounting for the module 100. Shim plates may be required between the vertical faces of the embedded plate 48 and the clip angle 50 to laterally position the module 10.

A further embodiment of the invention does not include reinforcing members of strength greater than the chords or studs, but rather relies solely upon the diaphragm action of the cladding 23 to reinforce the module 10, and upon the use of only two connections to reduce stresses within the module 10. Modules in accordance with this embodiment would be smaller, lighter and subjected to lower live loads than the modules described above. The sheet metal diaphragm 24 of the cladding 23 reinforce the module 10 to an adequate extent in such a case. The restraint means are also as described above including a leveling bolt 37 which applies loads to the top chord 16 at a point adjacent the module's centre of gravity to minimize torsional loads induced in the module 10. In this embodiment, the loads from the restraint means are low enough to be adequately accommodated by the unreinforced top chord 16 without bearing failure, buckling or tearing of cladding 23 connectors.

It will be apparent to those skilled in the art that variations may be made to the embodiments described herein that are within the scope of the invention. For example, a variant may be used wherein the top chord 16 consists of a single channel and the bottom chord 17 includes a reinforcing beam 26 or stub beam 46. The leveling bolt 37 suspends the module 10 from a mounting angle 34. The embedded angle 28 is positioned within the bottom of the slab 27 to provide a continuous upper slab surface. The mounting angle 34 includes a slotted hole through which the leveling bolt 37 projects such that the mounting angle 34 also performs the function of the horizontal plate 38 (in FIG. 3). In this variant the studs 18 are in compression under load supported by the bottom chord 17 rather than in tension suspended from the top chord 16.

I claim:

1. A curtain wall module for a building, comprising:

a frame having a top chord, a bottom chord and a plurality of transverse studs spaced at intervals along the length of the chords defining a plurality of panels, the top end of each stud being connected to the top chord and the bottom end of each stud being connected to the bottom chord, the top chord being a single downwardly open channel section, the bottom chord being a single upwardly open channel section, and with one chord being reinforced with a beam of strength greater than said channel section;

sheet form cladding mounted to the frame; and adjustable restraint means connected at two or more places along the top of the frame to the building structure for transferring the weight of the wall module, and the loads imposed upon the module, to the building structure.

2. A curtain wall module as claimed in claim 1, wherein the reinforcing beam is a hollow square section metal beam which coacts with the top chord and extends along substantially its entire length.

3. A curtain wall module as claimed in claim 1, wherein the reinforcing beam comprises at least one stub beam extending along a portion of the top chord and at least from one transverse stud to the next adjacent stud, and the sheet form cladding provides the frame with diaphragm strength.

4. A curtain wall module as claimed in claim 3, wherein the top chord has two stub reinforcing beams spaced along its length for engaging two adjustable restraint means for providing adjustment of the module vertically and transversely relative to the building structure.

5. A curtain wall module as claimed in claim 4, wherein the restraint means each have a bracket attached to and extending from the building, the bracket having a bolt threaded through it for engaging a stub beam attached to the top chord.

6. A curtain wall module as claimed in claim 5, wherein the restraint means includes a brace attached from the building to the stub beam, the brace providing a transfer of lateral loads from the module to the building.

7. A curtain wall module as claimed in claim 5, wherein the restraint means includes a brace attached from the building to a stud, the brace restraining the module laterally and having means coacting with the stud to allow relative vertical movement between the module and the building.

8. A curtain wall module as claimed in claim 7, wherein the stud is a roll formed sheet metal channel section defining a keyway for receiving a portion of the brace shaped to slidingly engage within the keyway.

9. A curtain wall module as claimed in claim 3, further comprising means for connecting and laterally aligning the bottom chord of the module with the top chord of a lower adjacent module.

10. A curtain wall module as claimed in claim 9, wherein the bottom chord of the upper module has a web defining a plurality of holes along the length of the channel, the lower adjacent module has a plurality of pins extending upwardly from the top chord or reinforcing beam, which pins are engageable through the holes in the bottom chord of the upper adjacent module, and further comprising transverse alignment means coacting with the pin and bottom chord to align the two modules.

11. A curtain wall module as claimed in claim 10, wherein the alignment means is a diagonally slotted rectangular washer sized to engage opposing longitudinal walls of the bottom chord channel section.

12. A curtain wall module as claimed in claim 1, wherein the cladding comprises a backing to which a weatherproof finishing material is attached.

13. A curtain wall module as claimed in claim 12, wherein the backing is sheet metal.

14. A curtain wall module as claimed in claim 13, wherein a layer of thermal insulating material is attached to the sheet metal and the weatherproof finishing material is attached to the layer of insulating material.

15. A curtain wall module as claimed in claim 1, wherein the top chord has a reinforcing beam attached substantially along its entire length, and two adjustable restraint means engage the open channel section of the top chord to provide adjustment for the module vertically and transversely relative to the building structure.

16. A curtain wall module as claimed in claim 1, wherein the top chord has a reinforcing beam attached substantially along its entire length, and the adjustable restraint means engage the open channel section of the top chord, the restraint means providing vertical adjustment for the module relative to the building, the restraint means having a bracket attached to and extending from the building, the bracket having a bolt threaded through it for engaging the open channel section of the top chord.

17. A curtain wall module as claimed in claim 16, wherein the restraint means includes a brace attached from the building to the reinforcing beam, the brace providing a transfer of lateral loads from the module to the building.

18. A curtain wall module as claimed in claim 16, wherein the restraint means includes a brace attached from the building to a stud, the brace restraining the module laterally and having means coacting with the stud to allow relative vertical movement between the module and the building.

19. A curtain wall module as claimed in claim 18, wherein the stud is a roll formed sheet metal channel section defining a keyway for receiving a portion of the brace shaped to slidingly engage within the keyway.

20. A curtain wall module as claimed in claim 1, further comprising means for connecting and laterally aligning the bottom chord of the module with the top chord of a lower adjacent module.

21. A curtain wall module as claimed in claim 20, wherein the bottom chord of the upper module has a web defining a plurality of holes along the length of the channel, the lower adjacent module has a plurality of pins extending upwardly from the top chord or reinforcing beam, which pins are engageable through the holes in the bottom chord of the upper adjacent module, and further comprising transverse alignment means coacting with the pin and bottom chord to align the two modules.

22. A curtain wall module as claimed in claim 21, wherein the alignment means is a diagonally slotted rectangular washer sized to engage opposing longitudinal walls of the bottom chord channel section.

23. A curtain wall module as claimed in claim 1, wherein the studs are roll formed sheet metal channel sections.

24. A curtain wall module for a building which module is used in combination with a span of window frames, the module comprising:

a frame having a top chord, a bottom chord and a plurality of transverse studs spaced at intervals along the length of the chords defining a plurality of panels, the top end of each stud being connected to the top chord and the bottom end of each stud being connected to the bottom chord, the top chord being a single downwardly open channel section, the bottom chord being a single upwardly open channel section, the studs being roll formed sheet metal channel sections with at least one stud being a reinforcing beam having a strength greater than that of the other studs;

sheet form cladding mounted to the frame; and restraint means for attaching the module to the building, the restraint means extending from the reinforcing beam to the building structure.

25. A curtain wall module as claimed in claim 24, wherein the frame has two spaced reinforcing beams.

26. A curtain wall module as claimed in claim 25, wherein the reinforcing beams are hollow square section metal columns.

27. A curtain wall module as claimed in claim 24, wherein the restraint means comprise back-to-back metal angles connected to the reinforcing beam which coact with means attached to the building for fixing the module in place.

28. A curtain wall module as claimed in claim 24, wherein the cladding is sheet metal providing diaphragm strength to the frame.

* * * * *